US008813323B2

(12) United States Patent
Sterner et al.

(10) Patent No.: US 8,813,323 B2
(45) Date of Patent: Aug. 26, 2014

(54) SHOCKPROOF QUICK-RELEASE FASTENER FOR AN END FITTING OF A SAFETY BELT

(75) Inventors: Jonas Sterner, Alingsas (SE); Peter Lundgren, Trollhattan (SE)

(73) Assignee: Autoliv Development AB, Värgärda (SE)

( * ) Notice: Subject to any disclaimer, the term of this patent is extended or adjusted under 35 U.S.C. 154(b) by 0 days.

(21) Appl. No.: 13/817,068

(22) PCT Filed: Jul. 21, 2011

(86) PCT No.: PCT/EP2011/003655

§ 371 (c)(1), (2), (4) Date: Feb. 14, 2013

(87) PCT Pub. No.: WO2012/022416

PCT Pub. Date: Feb. 23, 2012

(65) Prior Publication Data

US 2013/0139366 A1 Jun. 6, 2013

(30) Foreign Application Priority Data

Aug. 16, 2010 (DE) ..... 10 2010 034 498

(51) Int. Cl.
*A44B 11/25* (2006.01)

(52) U.S. Cl.
CPC ..... *A44B 11/2561* (2013.01); *A44B 11/253* (2013.01); *A44B 11/2569* (2013.01); *A44B 11/2546* (2013.01)
USPC ..... 24/633; 24/641; 24/629; 24/645

(58) Field of Classification Search
CPC ..... A45F 5/02; A62B 18/084; A62B 3/0473; F16B 21/165; F16B 21/09; A41D 13/0512; A41F 9/002; A44C 5/2071; B63H 9/10
USPC ..... 24/573.11, 704.1, 704.2, 549.11, 628, 24/629, 633, 640, 652, 456, 645
See application file for complete search history.

(56) References Cited

U.S. PATENT DOCUMENTS 3,144,697 A * 8/1964 Rosenberg ..... 24/599.4
5,067,211 A * 11/1991 van Riesen ..... 24/641

(Continued)

FOREIGN PATENT DOCUMENTS

DE 30 04 150 A1 8/1981
DE 31 09 248 A1 4/1982

(Continued)

OTHER PUBLICATIONS

PCT International Search Report—Dec. 23, 2011.

(Continued)

*Primary Examiner* — Robert J Sandy
*Assistant Examiner* — Rowland Do
(74) *Attorney, Agent, or Firm* — Brinks Gilson & Lione

(57) ABSTRACT

A quick release fastener for an end fitting of a safety belt having spaced apart first and second frame, a lockable insert tongue insertable between the frame plates, and a locking element moveable between a locking position in which the insert tongue is locked between the frame plates, and a release position. A locking element has at least two anchor surfaces facing one another, which at least form the stop at one outer face of the frame plates or of the insert tongue. In this way, a shockproof quick release fastener is provided which can be released without a special tool.

9 Claims, 5 Drawing Sheets

(56) References Cited

U.S. PATENT DOCUMENTS

| | | | | |
|---|---|---|---|---|
| 5,165,150 | A * | 11/1992 | van Riesen | 24/641 |
| 5,598,613 | A * | 2/1997 | Feile et al. | 24/641 |
| 6,550,112 | B2 * | 4/2003 | Rohrle et al. | 24/641 |
| 6,902,194 | B2 * | 6/2005 | Russell et al. | 280/801.1 |
| 8,528,173 | B2 * | 9/2013 | Sterner et al. | 24/633 |
| 2007/0000104 | A1 | 1/2007 | Zelmer | |
| 2012/0198665 | A1 * | 8/2012 | Krauss et al. | 24/593.1 |
| 2013/0174390 | A1 * | 7/2013 | Shroff et al. | 24/633 |

FOREIGN PATENT DOCUMENTS

| | | | |
|---|---|---|---|
| DE | 10 2008 004 338 | A1 | 7/2009 |
| DE | 10 2010 034 498 | A1 | 2/2012 |
| EP | 1 106 095 | A2 | 6/2001 |
| WO | WO 2009/090002 | A1 * | 7/2009 |

OTHER PUBLICATIONS

German Examination Report—Feb. 3, 2011.

* cited by examiner

SHOCKPROOF QUICK-RELEASE FASTENER FOR AN END FITTING OF A SAFETY BELT

CROSS-REFERENCE TO RELATED APPLICATION

This application claims priority to German Patent Application Number 10 2010 034 498.2, filed Aug. 16, 2010 and PCT/EP2011/003655, filed Jul. 21, 2011.

FIELD OF THE INVENTION

The present invention relates to a quick release fastener for an end fitting of a motor vehicle safety belt.

BACKGROUND OF THE INVENTION

Safety belts in a motor vehicle are usually fastened on one end via an end fitting firmly connected to the structure of the vehicle, whereas the safety belt can be rolled up at the other end on a belt retractor which is likewise firmly connected to the structure of the vehicle.

There are, however, different applications in which a releasable connection has to be provided between the end fitting and the structure of the vehicle. In a safety belt system with an end fitting tensioner, it can be necessary, for example, for design or logistical reasons that the end fitting tensioner is first fastened to the structure of the vehicle in a first assembly step, and then in a subsequent assembly step, the safety belt together with the end fitting is connected to the end fitting tensioner already fastened to the structure via a quick release fastener. In this case, the end fitting can be connected to the end fitting tensioner at the vehicle manufacturer's facility. For this purpose, the quick release fastener should be as cost-effective and easy to handle as possible, so that defective assemblies and long assembly times are avoided.

A generic quick release fastener is known, for example, from DE 10 2008 004 338 B4. However, the disadvantage of the quick release fastener described in DE 10 2008 004 338 B4 is that it is not shockproof in any spatial direction. Rather, an undesired rotation of a rotatable retaining element of the quick release fastener into a release position is prevented solely by inertial forces in case of a vehicle collision. In addition, a specifically configured special tool, which simultaneously engages in the quick release fastener with two specially shaped fork fingers, is necessary to release the quick release fastener. Although this is especially safe because an unauthorized user cannot release the quick release fastener without this special tool, it has been shown in practice that the use of a special tool is too complex and time consuming for an authorized technician to release the quick release fastener.

It is therefore the object of the present invention to provide a quick release fastener for an end fitting of a safety belt which is shockproof in any spatial direction and allows for a quick and at the same time dependable assembly. according to the present invention.

SUMMARY OF THE INVENTION

The quick release fastener according to the present invention has a first frame plate, a second frame plate, a lockable insert tongue and a locking element. The second frame plate is arranged spaced apart from the first frame plate. The lockable insert tongue can be inserted between the first frame plate and the second frame plate. The locking element can be moved between a locking position in which the insert tongue is locked, and a release position in which the insert tongue can be released. The locking element has at least two anchor surfaces facing one another which form a stop on at least one outer face of the frame plate and/or of the insert tongue.

The anchor surfaces are in this case "facing one another" if the normal vectors have components on the anchor surfaces which are aligned to one another.

In the event of inertial forces caused by a vehicle collision, the locking element is thus also protected against an undesired transverse displacement of the locking element with respect to the direction in which the insert tongue is inserted.

Preferentially the locking element has two pairs of anchor surfaces facing one another. The locking element is thus also protected against undesired rotations.

In a preferred embodiment of the quick release fastener, the first and/or the second frame plate has an opening through which the locking element extends.

Preferentially, the quick release fastener also has a retaining element which can be rotated around a rotary axis which extends from the first frame plate to the second frame plate and through the center of gravity of the retaining element, said rotation being between a retaining position and a resting position, wherein the retaining element secures the locking element in its locking position and releases the locking element in the resting position. The retaining element can in this way secure the locking element in its locking position and is itself mounted torque-free so that the inertial forces do not cause an undesired rotation of the retaining element in case of a vehicle collision.

The retaining element can be mounted in an especially easy manner between the frame plates, if the first and/or the second frame plate preferentially have an assembly guide for the retaining element on its inner face which guides the retaining element to its intended position. The retaining element then only has to be dropped between the frame plates. By means of an adequate assembly guide the retaining element then independently moves by itself under the force of gravity into the intended position in which, for example, a rotary axis can be inserted laterally through mounting eyelets provided for this purpose in the frame plates and through the center of gravity of the retaining element.

Another advantage of the invention is that a special tool with two specifically shaped fork fingers is no longer required to release the quick release fastener. A standard tool, such as a simple screwdriver or a hexagon spanner, which is inserted into the opening in the quick release fastener provided for that purpose, is sufficient to press and keep the retaining element in its resting position. As long as the retaining element is in the resting position, the locking element protruding laterally from a frame plate can be easily moved to its release position with a second standard tool, such as a simple screwdriver or hexagon spanner or even manually gripping it from the outside. The frame plates can be held with one hand, for example, by placing the thumb and index finger on both protruding sides of the locking element.

In a preferred embodiment the locking element has an inner section and two outer sections, the inner section being arranged between the outer sections, and one anchor surface being arranged at the one outer section and the other anchor surface being arranged at the other outer section. The locking element can be configured, for example, in the form of a small H-shaped plate, the legs of the H forming the outer sections situated on the outer faces of the frame plate, and the crossbar of the H forming the inner section which extends from one frame plate to the other.

Securing the locking element in its locking position is especially important. For this purpose, an opening of the first or second frame plate is preferentially configured such that the anchor surfaces stop outside at the first or second frame plate in case of a transverse displacement of the locking element relative to the direction of insertion of the insert tongue, when the locking element is in its locking position.

In order to allow for an especially easy insertion of the locking element it is an advantage if the opening of the first or of the second frame plate is configured such that the anchor surfaces do not stop outside at the first or second frame plate in case of a displacement of the locking element transversely to the direction in which the insert tongue is inserted when the locking element is in its release position. In its release position, the locking element can thus be comfortably inserted or retracted between the frame plates.

For example, the opening can have essentially the shape of a circle segment, which allows for pivoting the locking element by a definite angle around a pivoting axis extending transversely to the direction in which the insert tongue is inserted. The locking element in its locking position is at one of the stop sides of the circle segment-shaped opening, and at the other stop side of the circle segment-shaped opening, the locking element is in its release position. In the locking position, the locking element can engage behind a collar of a head section of the insert tongue and thus lock the insert tongue between the frame plates. On insertion of the insert tongue, the head section of the insert tongue can press the locking element into its release position as long as the retaining element is in its resting position. The insert tongue cannot be retracted when the locking element is in the locking position because the locking element is wedged against the collar of the head section of the insert tongue. For this purpose, the locking element first has to be brought manually to its release position, as described above.

The radius of the circle segment-shaped opening has to be so small at the stop side, where the locking element is in the locking position, that the anchor surface of the locking element stops outside at the first or second frame plate so as to prevent an undesired transverse displacement of the locking element relative to the direction in which the insert tongue is inserted. However, the radius of the circle segment-shaped opening is, preferentially larger at the stop side in which the locking element is in its release position, so that the anchor surface of the locking element does not stop outside at the first or second frame plate when one desires to insert or extract the locking element laterally. In this way it is easily possible to insert or replace the locking element.

A particularly easy assembly of the quick release fastener and a minimum number of parts to be connected to one another are in addition achieved in that the first frame plate at least in part forms one side of the housing of the quick release fastener and the second frame plate at least in part forms another side of the housing of the quick release fastener. The frame plates functioning as halves of the housing thus enclose the retaining and locking elements situated in between in the form of shells. The position of the locking element is then also visible from the outside and can easily be checked.

Alternatively, the frame plates can also be enclosed protectively by a separate housing in order to ensure greater safety against undesired external factors.

A first opening can then be provided in the separate housing through which a first actuating element can be inserted into the quick release fastener in order to bring the retaining element to its resting position and hold it in place. In addition, a second opening can be provided in the separate housing through which a second actuating element can be inserted into the quick release fastener in order to bring the retaining element to its release position, as long as the first actuating element keeps the retaining element in its resting position. The actuating elements can be standard tools, such as a screwdriver or a hexagon spanner and need not be fork fingers of a special tool specifically shaped for that purpose.

BRIEF DESCRIPTION OF THE DRAWINGS

The invention will be explained in more detail hereafter with reference to the figures which show a preferred embodiment of the invention.

DETAILED DESCRIPTION OF THE INVENTION

Figure 1:
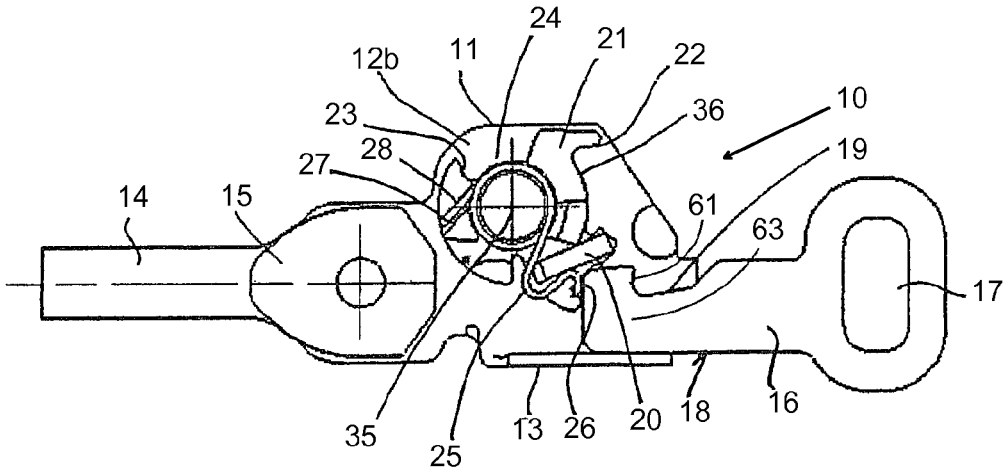
FIG. 1 shows a lateral inner view of a quick release fastener at the beginning of the insertion of the insert tongue into the quick release fastener.

As is apparent from FIG. 1, the quick release fastener 10 consists of a U-shaped lock housing 11 with lateral frame plates 12*a*, 12*b*, which are connected via a bar 13 and between them form the insert path for an insert tongue 16. For the sake of better visualization, only the rear frame plate 12*b* is shown in FIG. 1. At its one (left) end, the lock housing 11 is connected via a fastening fitting 15 to a cord (or cable) 14 preferentially leading to an end fitting tensioner. The insert tongue 16 that can be inserted from the other (right) side into the lock housing 11 has an eyelet 17 for the connection of a safety belt webbing (not shown).

A locking recess 19 is arranged opposite the back 18 of the insert tongue 16 that slides over the bar 13 when the insert tongue 16 is inserted into the lock housing 11. A plate-like pivotably mounted locking element 20 can be pivoted into said recess by pivoting the locking element 20 counterclockwise from the release position shown in FIG. 1 so that—as is apparent from FIG. 3—the (right) end of the plate-like locking element 20 facing the insert tongue 16 is raised, and the other (left) end at the same time dips into the locking recess 19 of the insert tongue 16 and locks it.

Figure 2:
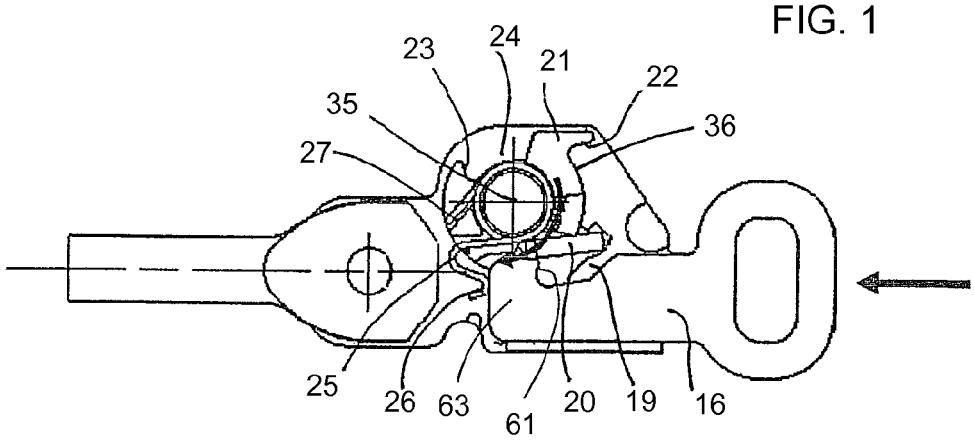
FIG. 2 shows a quick release fastener according to FIG. 1, in which the locking element is shown shortly before it is in its locking position.
Figure 3:
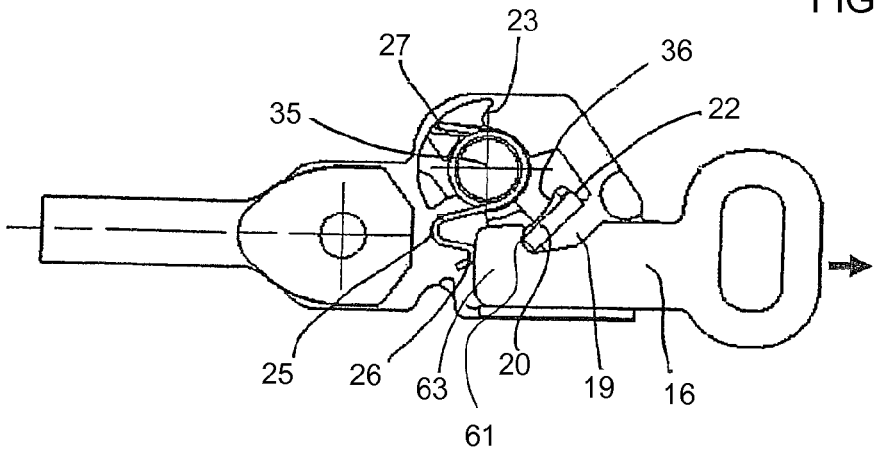
FIG. 3 shows a quick release fastener according to FIGS. 1 and 2 in which the locking element is in its locking position.

In order to secure the locking element 20 in its locking position and in order to simultaneously make the quick release fastener 10 shockproof against acceleration forces acting in the longitudinal direction of the fastener, a retaining element 21 is arranged rotatable in the lock housing 11; the center of gravity 35 of a mass formed by the retaining element 21 and a spring 25, which is still to be described, at the same time forming the pivoting point for the retaining element 21 to pivot between the resting position apparent from FIG. 1 or FIG. 2, and the retaining position apparent from FIG. 3. However, it can also be sufficient to use only the center of gravity 35 of the retaining element 21 for the determination of the pivoting point for pivoting of the retaining element 21. The retaining element 21 has a limit stop 22 by means of which it overlaps and fixes the plate-like locking element 20 in its locking position. By creating a cut-out 24, an actuating stop 23 is additionally formed at the retaining element 21, which in the retaining position of the retaining element 21 (see FIG. 3), extends into a channel running parallel to the insert tongue 16, into which an actuating element 29 in the form of a standard tool, such as a screwdriver or hexagon spanner, can be inserted (see FIG. 6) to release the retaining element 21.

A spring 25 in the form of a torsion spring with two free ends 26 and 27 is further arranged in the lock housing, wherein the one offset end 26 of the spring 25 extends into the motion path of the insert tongue 16 so that the end 26 of the spring is acted upon by the insert tongue 16. The other end 27 of the spring 25 is inserted into a channel 28 configured at the retaining element 21 so that a direct coupling of the end 27 of the spring to the retaining element 21 results.

As shown in FIG. 2, the insert tongue 16 can thus be inserted into the lock housing 11. The insert tongue 16 with its front end abuts against the end 26 of the spring 25 and consequently tenses the spring 25. At the same time, the front, beveled edge of the insert tongue 16 raises the plate-like locking element 20 at its inner edge. As soon as this inner edge reaches the locking recess 19 configured in the insert tongue 16, the locking element 20 on the one hand, pivots into the locking recess 19, wherein the spring 25 tensioned by the insertion movement of the insert tongue 16 into the lock housing 11 rotates the retaining element 21 clockwise via the end 27 of the spring. In this case, a surface 36 is arranged at the retaining element 21 such that the pivoting movement of the locking element 21 is guided in its locking position into the locking recess by the rotation of the retaining element 21. At the end of the locking path, the retainer stop 22 of the retaining element 21 and/or the surface 36 presses against the locking element 20 and thus prevents the movement of the locking element 20 to its release position. In this locking position, the retaining element is still under the action of the spring 25 tensioned by the insert tongue 16 (see FIG. 3).

Since the rotary axis of the retaining element 21 coincides with its center of gravity 35, no torque results from on the lock housing 11 from the acceleration forces acting in the longitudinal direction, an automatic movement of the retaining element 21 against the force of the spring 25 is prevented and the quick release fastener 10 is therefore kept in the locked state.

Figure 6:
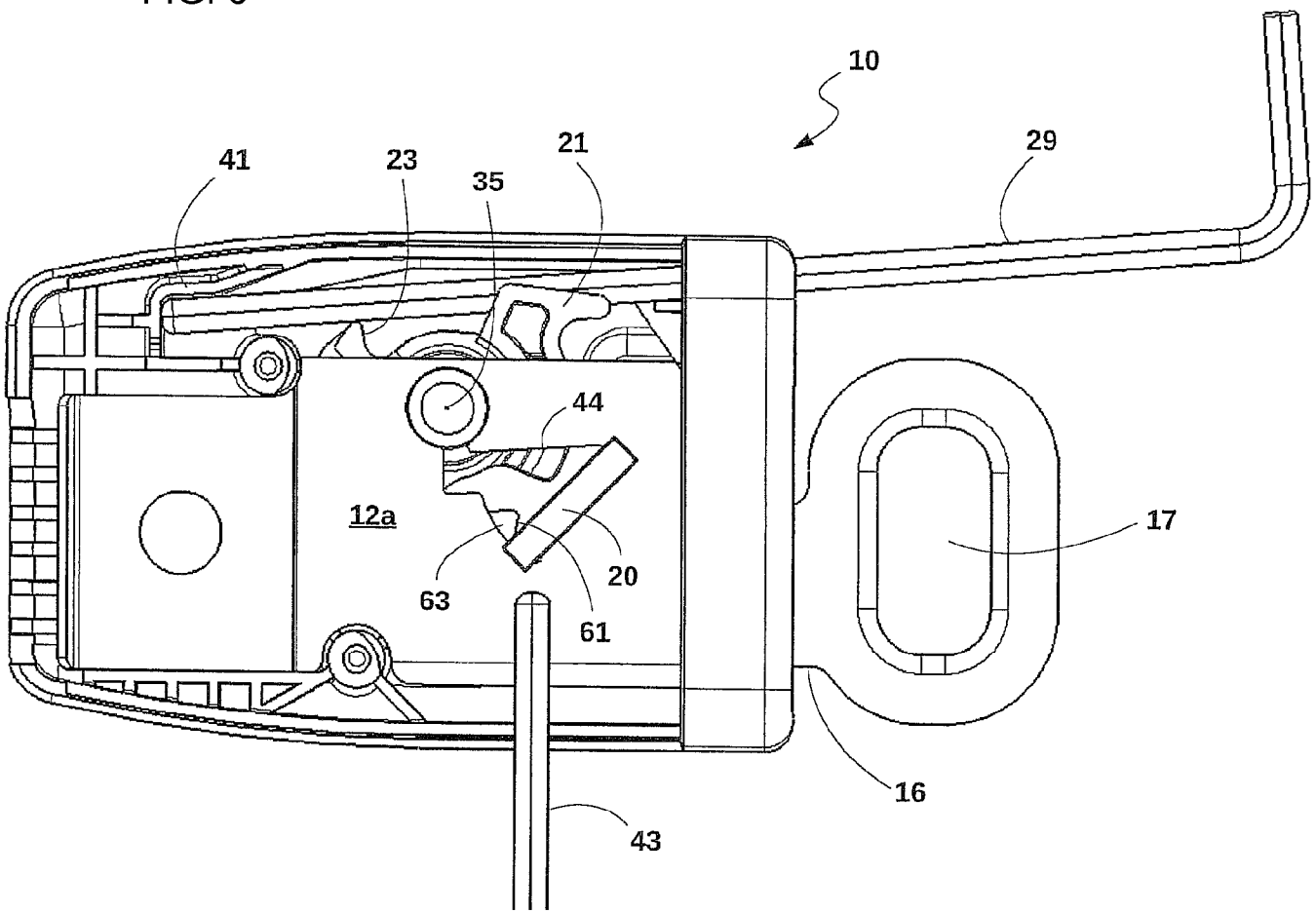
FIG. 6 shows a lateral half-section of a quick release fastener according to the preceding figures with engaging actuating elements to release the quick release fastener.

Now if a quick release fastener 10 of this kind is to be opened by means of an actuating element, it is possible, as shown in FIG. 6, to use an actuating element 29 in the form of a standard hexagon Allen wrench for this purpose, whose tip can be pressed against the raised actuating stop 23 in the retaining position of the retaining element 21 in order to rotate the retaining element 21 counterclockwise and against the spring force of the spring 25 to its resting position. Advantageously, at the end of the channel into which the actuating element 29 can be inserted, the quick release fastener 10 has a receiving section 41 into which the end of the actuating element 29 can be inserted. Viewed from the actuating element 29, the receiving section 41 is located behind the actuating stop 23 when the retaining element 21 is in the retaining position. As soon as the retaining element 21 rotates counterclockwise from the retaining position under the pressure of the tip of the actuating element 29 on the actuating stop 23, said actuating stop 23 moves out of the channel for the actuating element 29. As soon as the channel for the actuating element 29 is free, the actuating element 29 advances with the tip into the receiving section 41 (see FIG. 6) and is secured inside it against lateral movements. Although the spring force of the spring 25 presses the retaining element 31 clockwise toward the retaining position, the actuating element 29 inserted into the receiving section 41 blocks the rotational motion at the actuating stop 23, so that the retaining element 21 remains in the resting position as long as the actuating element 29 is inserted. With the inserted actuating element 29 the locking element 20 can now be brought from its locking position to its release position with another actuating element 43, as shown in FIG. 6, in the form of a standard hexagon Allen wrench or also manually, so that the insert tongue 16 can be retracted. The retracting action is supported by the tensioned spring 25, which then largely relaxes and is again available for another insertion process of the insert tongue 16.

Another embodiment of the invention (not shown) provides that the actuating element can also be fitted laterally to the lock housing 11, namely transversely to the plane defined by the housing plates 12*a*, 12*b* of the lock housing, the actuating element having projections attached thereon such that the retaining element 21 is caused to rotate from its retaining position (FIG. 3) in the direction of the resting position (FIG. 1), as well as the locking element 20 to tilt between its locking position (FIG. 3) and its release position (FIG. 1).

Figure 4A:
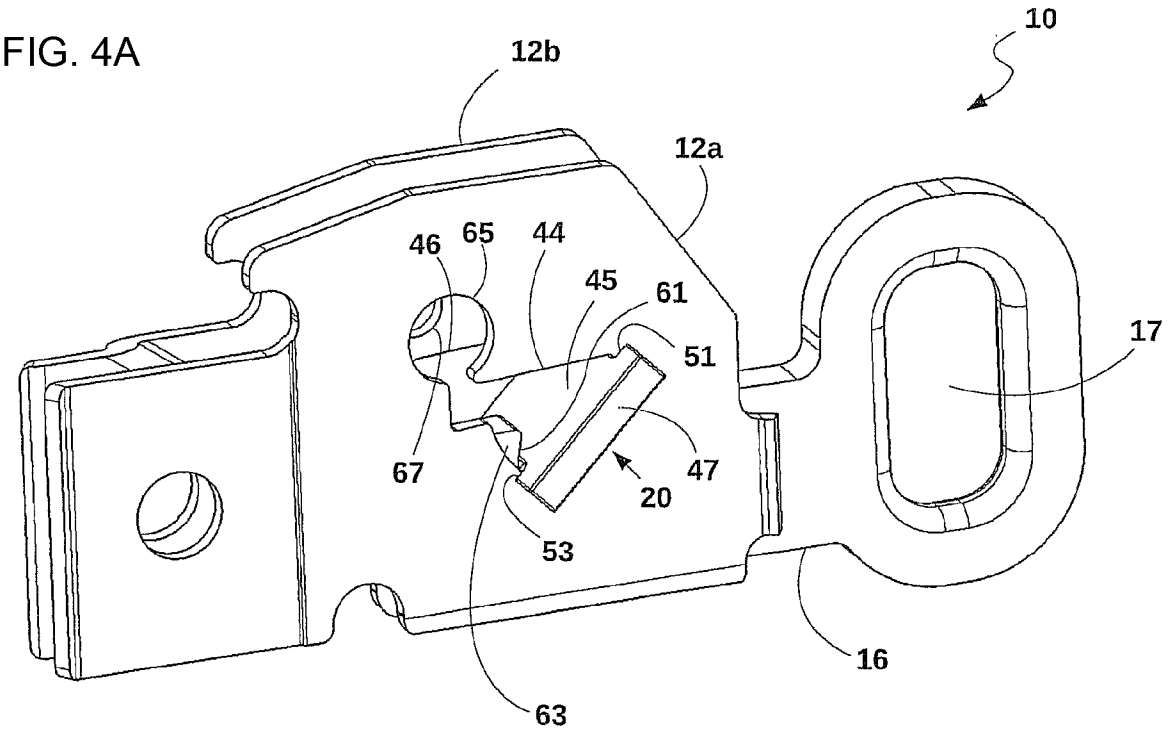
FIG. 4A shows a first perspective view of the frame plates, the locking element and the insert tongue of a quick release fastener according to FIGS. 1, 2 and 3.
Figure 4B:
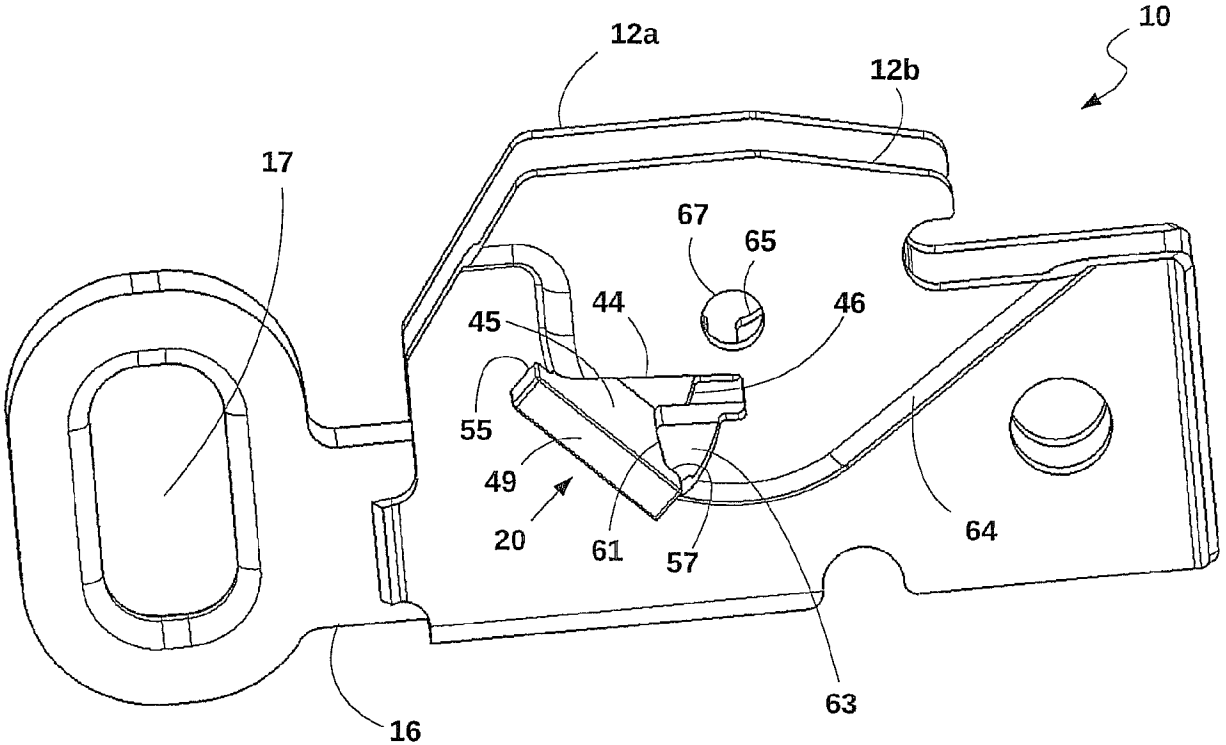
FIG. 4B shows a second perspective view of the frame plates, the locking element and the insert tongue of a quick release fastener according to FIGS. 1, 2 and 3.
Figure 5:
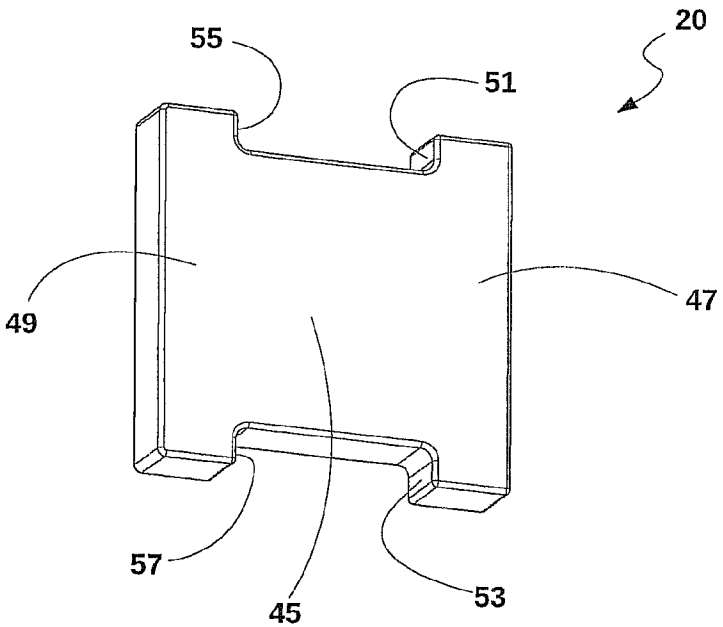
FIG. 5 shows a perspective view of a locking element of a quick release fastener according to the preceding figures.

FIGS. 4A and 4B show the quick release fastener 10 without the retaining element 20, the spring 25, the fastening fitting 15 and the cord 14 preferentially leading to the end fitting tensioner (not shown). Only the frame plates 12*a*, 12*b*, the locking element 20 and the insert tongue 16 are shown from one side (FIG. 4A) and from the other side (FIG. 4B). The locking element 20 is in its locking position and locks the insert tongue 16 inserted between the frame plates 12*a*, 12*b*. The first frame plate 12*a* as well as the second frame plate 12*b* have an opening 44, 46, through which the locking element 20 extends. The locking element 20 is configured as a small H-shaped plate and has, as is clearly visible in FIG. 5, an inner section 45 which forms the crossbar of the "H", and two outer sections 47, 49 which form the legs of the "H". The inner section 45 is thus arranged between the outer sections 47, 49. The outer sections 47, 49 are arranged on the outer face of the first frame plate 12*a* and respectively second frame plate 12*b*, and the inner section 45 extends between the frame plates 1. The outer sections 47, 49 have two anchor surfaces 51, 52 and 55, 57 each, the anchor surfaces 51, 53 being allocated to the outer section 47 and anchor surfaces 55, 57 to the other outer section 49.

The frame plates 12*a*, 12*b* are essentially shaped symmetrically to one another and constructed spaced apart parallel to one another. The openings 44, 46 in the frame plates 12*a*, 12*b* are essentially configured circle segment-shaped, such that the locking element 20 can be pivoted between two angular positions. The angular position running obliquely downward in FIGS. 4A and 4B corresponds to the locking position of the locking element 20, in which the inner section 45 of the locking element 20 engages behind a collar 61 of a head section 63 of the insert tongue 16 and thus locks the insert tongue 16 between the frame plates 12*a*, 12*b* in the direction of retraction. The essentially horizontal angular position corresponds to the release position of locking element 20, in which the head section 63 of the insert tongue 16 can be retracted from the frame plates 12*a*, 12*b* past the inner section 45 of the locking element 20.

In the locking position of the locking element 20 the anchor surfaces 51, 53, 55, and 57 stop at the frame plates 12 from the outside when the locking element 20 is displaced transversely to the direction in which the insert tongue 16 is inserted. In the exemplary embodiment shown in FIG. 4B, the anchor surface 57 stops at the inserted insert tongue 16 when the locking element 20 is displaced transversely to the direction in which the insert tongue 16 is inserted. It is thus also possible that only one frame plate 12*a* has an opening 44 through which the locking element 20 extends. At the other side, an indentation (not shown) for example, can be sufficient in the other frame plate 12*b* in order to guide the locking element 20. The anchor surfaces 55, 57 can then also stop at the inserted insert tongue 16 when the locking element 20 is displaced transversely to the direction in which the insert tongue 16 is inserted. The locking element 20 is thus secured in the locking position against lateral displacements which can be caused by inertial forces during a collision.

Another difference between the shown first frame plate 12*a* and the second frame plate 12*b* is that the second frame plate 12*b* is offset outwardly over the entire upper area and thus forms a valley-shaped assembly guide 64. During the assembly, the retaining element 21 can be transferred, if need be, together with the spring 25 to its intended position by means of the assembly guide 64. As a result, the retaining element 21 can be mounted in an especially easy manner between the frame plates 12*a*, 12*b*. The retaining element 21 only needs to be dropped between the frame plates 12*a*, 12*b*, whereby, owing to the valley-shaped assembly guide 64, the retaining element 21 independently moves under its own gravity to the intended position, in which, for example, the rotary axis of the retaining element 21 is flush with the mounting eyelets 65, 67 in the frame plates 65, 67 provided for mounting the rotary axis of the retaining element 21.

However, in the shown embodiment a corresponding opening 44, 46 is provided in each of the frame plates 12*a*, 12*b*. Where the locking element 20 is in the release position, the openings 44, 46 are enlarged radially relative to the pivoting axis of the locking element 20 so that at least one anchor surface 53 or 57 does not stop at the first frame plate 12*a* or at the second frame plate 12*b* when the locking element 20 is in its release position. In consequence, the locking element 20 can be aligned in its release position such that with a small displacement of the locking element 20 away from its pivoting axis the anchor surfaces 51 or 55 no longer stop outside at the first frame plate 12*a* or at the second frame plate 12*b*. In this way, the locking element 20 can be retracted laterally and replaced, for example, in a convenient manner. As a result of this, the assembly of the quick release fastener is also simplified because the frame plates 12*a*, 12*b* can thus be joined together and welded as one piece or can be already welded to one another, or otherwise be firmly connected to one another, before the other components are assembled. The retaining element 21 can also be subsequently inserted into the mounting eyelets 65, 67 in the frame plates 12*a*, 12*b* for the rotary axis of the retaining element 21. In the shown exemplary embodiment, the mounting eyelet 65 of the first frame plate 12*a* is connected to the circle segment-shaped opening 44 of the first frame plate 12*a*. The mounting eyelet 67 of the second frame plate 12*b*, on the other hand, is configured separately from the circle segment-shaped opening 46 of the second frame plate 12*b*.

While the above description constitutes the preferred embodiment of the present invention, it will be appreciated that the invention is susceptible to modification, variation and change without departing from the proper scope and fair meaning of the accompanying claims.

The invention claimed is:

1. A quick release fastener for an end fitting of a safety belt comprising:

a first frame plate and a second frame plate, the second frame plate spaced apart from the first frame plate, the first frame plate and the second frame plate forming a frame, a lockable insert tongue insertable between the first frame plate and the second frame plate, and a locking element movable between a locking position in which the insert tongue is locked between the first and second frame plates, and a release position in which the insert tongue is released the locking element having at least two anchor surfaces arranged on opposite sides outside the frame and facing one another, the two anchor surfaces forming at least one stop on at least one outer face of the frame plates or of the insert tongue acting to restrict lateral movement of the locking element, each of the two anchor surfaces further extending parallel to and overlapping with the frame plates in the locking position.

2. The quick release fastener according to claim 1 further comprising in that the locking element has two pairs of the anchor surfaces facing one another.

3. The quick release fastener according to claim 2 further comprising in that the locking element has an inner section and two outer sections, the inner section being arranged between the outer sections, and one of the pairs of the anchor surfaces being arranged on one of the outer sections and the other of the two anchor surfaces being arranged on the other of the pairs of outer sections.

4. The quick release fastener according to claim 1 further comprising in that the first frame plate or the second frame plate has an opening through which the locking element extends.

5. The quick release fastener according to claim 4 further comprising in that the opening of the first frame plate or of the second frame plate is configured such that, when the locking element is displaced transversely to the direction in which the insert tongue is inserted, at least one anchor surface stops outside at the first frame plate or at the second frame plate when the locking element is in its locking position.

6. The quick release fastener according to claim 5, further comprising in that the locking element having two pairs of the anchor surfaces and in that the opening of the first frame plate or of the second frame plate is configured such that when the locking element is displaced transversely to the direction in which the insert tongue is inserted, at least one of the anchor surface of the two pairs does not stop at the first frame plate or at the second frame plate from the outside when the locking element is in its release position.

7. The quick release fastener according to claim 1 further comprising in that the first and second frame plates at least in part form the sides of a housing of the quick release fastener.

8. The quick release fastener according to claim 1 further comprising a retaining element which is rotatable around a rotary axis extending between the first frame plate and the second frame plate through the center of gravity of the retaining element between a retaining position and a resting position, the retaining element fixing the locking element in locking position and releasing the locking element to the release position in the resting position.

9. The quick release fastener according to claim 8, further comprising in that the first frame plate or the second frame plate forms an assembly guide on an inner face for the retaining element which guides the retaining element to its intended position during assembly of the fastener.

* * * * *